US011417950B2

(12) United States Patent
Liu et al.

(10) Patent No.: US 11,417,950 B2
(45) Date of Patent: Aug. 16, 2022

(54) INTEGRATED WAVE-ABSORBING AND WAVE-TRANSPARENT APPARATUS AND RADOME

(71) Applicant: KUANG-CHI CUTTING EDGE TECHNOLOGY LTD., Shenzhen (CN)

(72) Inventors: Ruopeng Liu, Shenzhen (CN); Zhiya Zhao, Shenzhen (CN); Kangqiang Chen, Shenzhen (CN); Sucheng Li, Shenzhen (CN)

(73) Assignee: KUANG-CHI CUTTING EDGE TECHNOLOGY LTD., Shenzhen (CN)

( * ) Notice: Subject to any disclaimer, the term of this patent is extended or adjusted under 35 U.S.C. 154(b) by 21 days.

(21) Appl. No.: 17/157,206

(22) Filed: Jan. 25, 2021

(65) Prior Publication Data

US 2021/0143537 A1 May 13, 2021

Related U.S. Application Data

(63) Continuation of application No. PCT/CN2018/125126, filed on Dec. 29, 2018.

(30) Foreign Application Priority Data

Jul. 27, 2018 (CN) ..... 201810842877.3
Jul. 27, 2018 (CN) ..... 201821205561.5

(51) Int. Cl.
*H01Q 1/42* (2006.01)

(52) U.S. Cl.
CPC ..... *H01Q 1/42* (2013.01)

(58) Field of Classification Search
CPC ..... H01Q 1/42
(Continued)

(56) References Cited

U.S. PATENT DOCUMENTS

2011/0183133 A1* 7/2011 Osada ..... C01G 23/005
252/62.51 R

FOREIGN PATENT DOCUMENTS

| | | |
|---|---|---|
| CN | 102480909 A | 5/2012 |
| CN | 107946763 A | 4/2018 |
| CN | 108270085 A | 7/2018 |

OTHER PUBLICATIONS

International Search Report for corresponding PCT/CN2018/125126, dated Apr. 28, 2019, 2 Pages.
(Continued)

*Primary Examiner* — Peguy Jean Pierre
(74) *Attorney, Agent, or Firm* — Armstrong Teasdale LLP

(57) ABSTRACT

The disclosure provides an integrated wave-absorbing and wave-transparent apparatus and a radome. The integrated wave-absorbing and wave-transparent apparatus includes: a wave-transparent structure, including a first substrate and a metal patch unit located on opposite surfaces of the substrate; and a wave-absorbing structure, disposed on the wave-transparent structure and including a first wave-absorbing unit and a second wave-absorbing unit that are perpendicular to each other, where the first wave-absorbing unit and the second wave-absorbing unit each includes: a second substrate; and a plurality of metal sections and a plurality of stop-bands that are located on surfaces of the second substrate, where the plurality of metal sections and the plurality of stop-bands are connected alternately to form an absorption ring, and the metal patch unit is configured to be perpendicular to each of an absorption ring of the first wave-absorbing unit and an absorption ring of the second wave-absorbing unit.

18 Claims, 9 Drawing Sheets

(58) Field of Classification Search
USPC ..... 343/872
See application file for complete search history.

(56) References Cited

OTHER PUBLICATIONS

Zhiwei Sun et al., "Selective wave-transmitting electromagnetic absorber through composite metasurface", AIP Advances, American Institute of Physics, Nov. 15, 2017 (Nov. 15, 2017), vol. 7, No. 11, Abstract, Sections I and II, Figure 1, 2 Huntington Quadrangle, Melville, NY 11747.
Hong Zhu et al., "Tunable frequency selective radome with broadband absorbing properties". 2017 Progress in Electromagnetics Research Symposium—Spring (Piers), IEEE, May 22, 2017 (May 22, 2017), pp. 2478-2482, Sections III and IV, Figures 1-4.
Fanfan Xu et al., "Dual-polarization absorptive/transmissive frequency-selective surface utilizing composite metamaterial", 2017 Sixth Asia-Pacific Conference On Antennas and Propagation (APCAP), IEEE, Oct. 16, 2017 (Oct. 16, 2017), pp. 1-3, Abstract, Figure 3.
Extended European Search Report for corresponding PCT/CN2018/125126, dated Mar. 4, 2022; 11 pages.

* cited by examiner

INTEGRATED WAVE-ABSORBING AND WAVE-TRANSPARENT APPARATUS AND RADOME

CROSS-REFERENCE TO RELATED APPLICATIONS

The present application is a continuation of International Patent Application No. PCT/CN2018/125126, filed Dec. 29, 2018, which claims the priority of Chinese Patent Application No. 201810842877.3, filed Jul. 27, 2018, and Chinese Patent Application No. 201821205561.5, filed Jul. 27, 2018, which are herein incorporated by reference in their entirety.

TECHNICAL FIELD

The disclosure generally relates to the field of communications technologies, and more specifically, to an integrated wave-absorbing and wave-transparent apparatus and a radome.

BACKGROUND

With continuous development of modern electromagnetic technologies, electromagnetic spectrums are divided in an increasingly fine-grained manner, and a boundary is increasingly unclear. In addition, the development of the electromagnetic technologies also leads to electromagnetic pollution that threatens human existence. Currently, wave absorption is an important means to ensure electromagnetic compatibility and control electromagnetic pollution between different frequency bands. However, wave absorption also faces some problems. A wave-absorbing structure usually has no wave-transparent capability, thereby causing a particular degree of interference to operating of a radio device that should operate properly.

Currently, common integrated wave-absorbing and wave-transparent structures are in a plurality of forms. Metal narrowbands are applied to metal strips loaded on a lumped resistor to manufacture a capacitor and an inductor, so that this LC circuit can localize energy in the LC circuit at a specific frequency, to isolate the resistor and achieve a wave-transparent effect. This structure can implement integration of wave-absorbing and wave-transparent functions. However, because sizes of the capacitor and the inductor manufactured by using the metal narrowbands are very small, a very high requirement is imposed on processing. In addition, a capacitance and an inductance change accordingly after an incident angle changes. Consequently, loop resonance changes, thereby affecting wave-absorbing and wave-transparent performance.

SUMMARY

For the disadvantages of the related art, the disclosure provides an integrated wave-absorbing and wave-transparent structure that achieves a high wave transmittance in an L band and a high absorption rate in a Ku band within a wide angular-domain range, and a radome including the structure.

According to an embodiment of the disclosure, an integrated wave-absorbing and wave-transparent apparatus is provided, including: a wave-transparent structure, including a first substrate and a metal patch unit located on opposite surfaces of the first substrate; and a wave-absorbing structure, disposed on the wave-transparent structure and including a first wave-absorbing unit and a second wave-absorbing unit that are perpendicular to each other, where the first wave-absorbing unit and the second wave-absorbing unit each includes: a second substrate; and a plurality of metal sections and a plurality of stop-bands that are located on surfaces of the second substrate, where the plurality of metal sections and the plurality of stop-bands are connected alternately to form an absorption ring, and the metal patch unit is configured to be perpendicular to each of an absorption ring of the first wave-absorbing unit and an absorption ring of the second wave-absorbing unit.

Preferably, the plurality of stop-bands include a first stop-band and a second stop-band that are the same; and the plurality of metal sections include a first metal section and a second metal section, where the first metal section, the second metal section, the first stop-band, and the second stop-band are connected to jointly form an absorption ring, the first stop-band is located between a first end of the first metal section and a first end of the second metal section, and the second stop-band is located between a second end of the first metal section and a second end of the second metal section.

Preferably, the first metal section and the second metal section each include a semicircular ring and parallel metal sections that extend from two ends of the semicircular ring.

Preferably, the metal patch unit includes a metal solid patch or a metal ring patch.

Preferably, a length of a center line of the metal ring patch is an integer multiple of a wavelength corresponding to a resonance frequency of the metal patch unit.

Preferably, the metal ring patch further includes an inner ring and an outer ring that are concentric; the inner ring is located on a first surface of the first substrate; and the outer ring is located on a second surface of the first substrate, where the first surface is opposite to the second surface, and the length of the center line of the metal ring patch is an average value of a length of the inner ring and a length of the outer ring.

Preferably, the wave-transparent structure further includes: a first dielectric layer, located on the first surface of the first substrate and covering the inner ring; and a second dielectric layer, located on the second surface of the first substrate and covering the outer ring.

Preferably, the inner ring and the outer ring each is a square ring, a rectangular ring, a circular ring, or a hexagonal ring.

Preferably, the stop-band further includes an inductor and/or a capacitor.

According to another aspect of the disclosure, a radome is provided, wherein the radome includes the integrated wave-absorbing and wave-transparent apparatus according to any one of the foregoing aspects.

In the disclosure, a three-dimensional metamaterial and a simple two-dimensional frequency selection surface are cascaded, and a structure is simple. The integrated wave-absorbing and wave-transparent apparatus according to the embodiments of the disclosure can achieve a high wave transmittance in an L band and a high absorption rate in a Ku band within a wide angular-domain range. The integrated wave-absorbing and wave-transparent apparatus may be used as a protection cover of a device such as a communications antenna or a radar, and can ensure absorption in a wide frequency band and a wide angular domain while ensuring normal operating of an antenna, thereby ensuring a good operating environment for the antenna.

BRIEF DESCRIPTION OF DRAWINGS

To describe the technical solutions in the embodiments of the disclosure or in the related art more clearly, the following briefly describes the accompanying drawings required for describing the embodiments or the related art. Apparently, the accompanying drawings in the following description show some embodiments of the disclosure, and persons of ordinary skill in the art may still derive other drawings from these accompanying drawings without creative efforts.

DESCRIPTION OF EMBODIMENTS

To make the objectives, technical solutions, and advantages of the embodiments of the disclosure clearer, the following clearly and completely describes the technical solutions in the embodiments of the disclosure with reference to the accompanying drawings in the embodiments of the disclosure. Apparently, the described embodiments are some but not all of the embodiments of the disclosure. All other embodiments obtained by persons of ordinary skill in the art based on the embodiments of the disclosure without creative efforts shall fall within the protection scope of the disclosure.

In the disclosure, a wave-absorbing structure and a wave-transparent structure are separately designed and then cascaded to implement an integrated wave-absorbing and wave-transparent apparatus. A currently used method is: superposing an incident wave and a reflected wave that is produced after an incident wave undergoes resonant reflection on the wave-transparent structure, and after the superposition, disposing a resistor at a position with relatively strong electric field intensity to absorb electromagnetic waves. Therefore, the wave-transparent structure needs to have a high wave transmittance in a low L band and have a high cut-off feature in a Ku band. In addition, for the wave-absorbing structure, a resistor needs to be disposed at a position with relatively strong electric field intensity after an incident wave and a reflected wave are superposed in the Ku band, and needs to have a high wave transmittance in the L band. The L band is a radio band including a frequency ranging from 1 GHz to 2 GHz, and the Ku band is a frequency band ranging from 12.75 GHz to 18.1 GHz.

Figure 1:
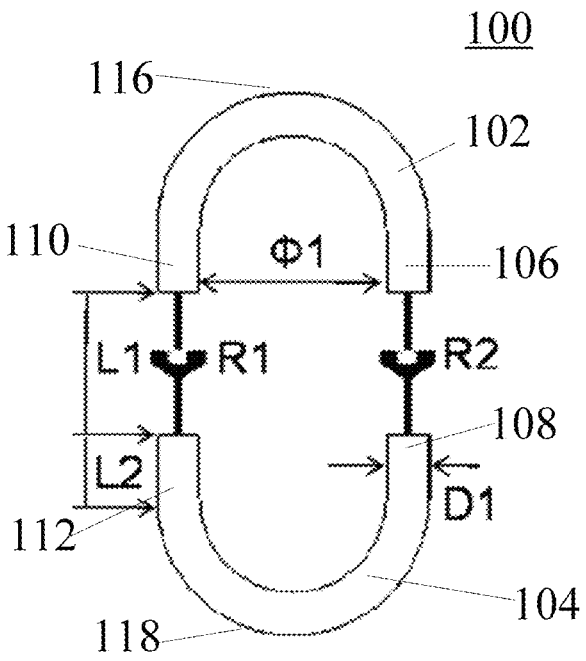
FIG. 1 is a schematic structural diagram of an example of an absorption ring of a wave-absorbing structure according to an embodiment of the disclosure.
Figure 2:
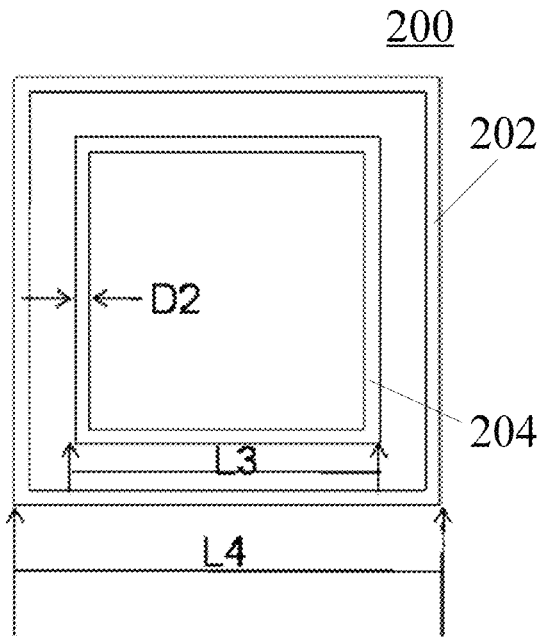
FIG. 2 is a schematic structural diagram of an example of an inner ring and an outer ring of a wave-transparent structure according to an embodiment of the disclosure.
Figure 3A:
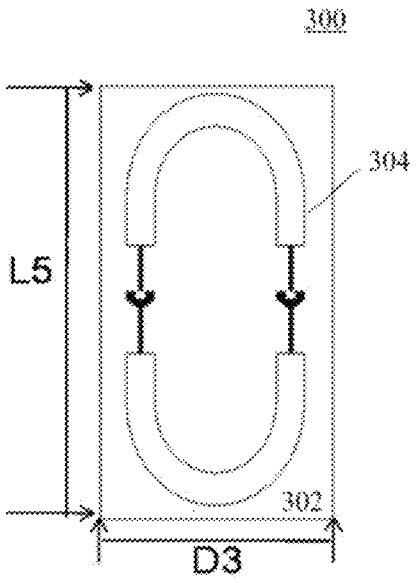
FIG. 3A and FIG. 3B are a front view and a side view of an example of a wave-absorbing structure according to an embodiment of the disclosure.
Figure 3B:
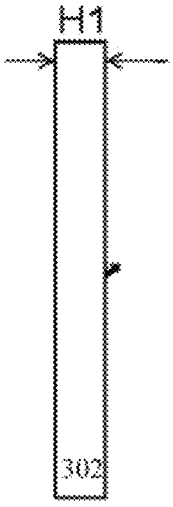
Figure 4:
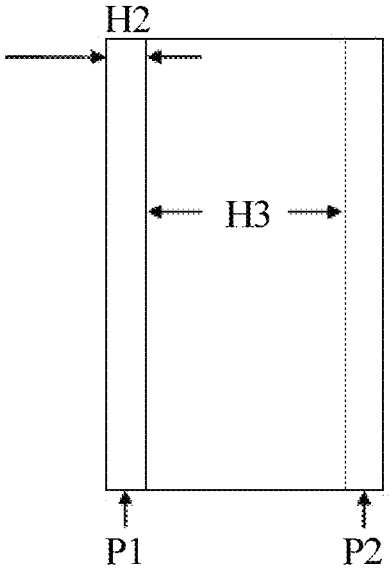
FIG. 4 is a side view of an example of a wave-transparent structure according to an embodiment of the disclosure.
Figure 5:
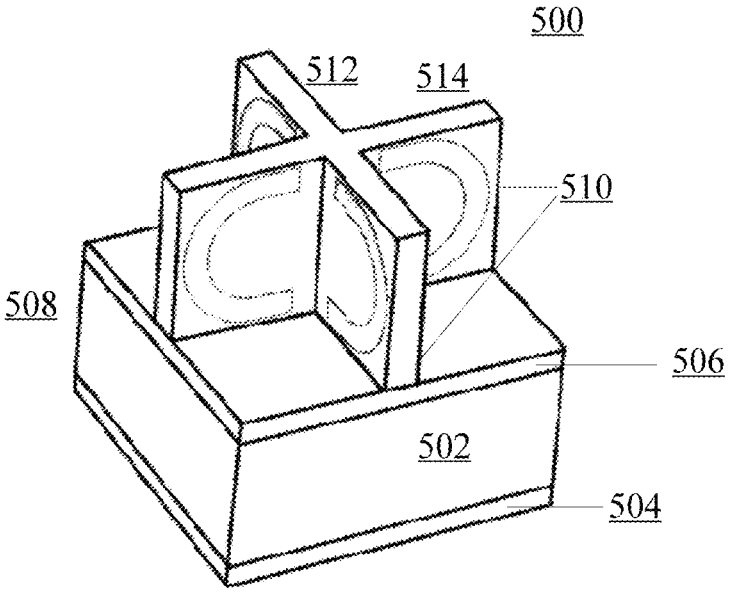
FIG. 5 is a three-dimensional diagram of an integrated wave-absorbing and wave-transparent apparatus according to an embodiment of the disclosure.

FIG. 1 is a schematic structural diagram of an example of an absorption ring of a wave-absorbing structure according to an embodiment of the disclosure. FIG. 2 is a schematic structural diagram of an example of an inner ring and an outer ring of a wave-transparent structure according to an embodiment of the disclosure. FIG. 3A and FIG. 3B are a front view and a side view of an example of a wave-absorbing structure according to an embodiment of the disclosure. FIG. 4 is a side view of an example of a wave-transparent structure according to an embodiment of the disclosure. FIG. 5 is a three-dimensional diagram of an integrated wave-absorbing and wave-transparent apparatus according to an embodiment of the disclosure. The following describes in detail the integrated wave-absorbing and wave-transparent apparatus with reference to FIG. 1 to FIG. 5.

Referring to FIG. 5, an integrated wave-absorbing and wave-transparent apparatus 500 according to the disclosure includes: a wave-transparent structure 508, including a first substrate and a metal patch unit located on opposite surfaces of the first substrate; and a wave-absorbing structure 510, disposed on the wave-transparent structure 508 and including a first wave-absorbing unit 512 and a second wave-absorbing unit 514 that are perpendicular to each other, where the first wave-absorbing unit 512 and the second wave-absorbing unit 514 each includes: a second substrate; a plurality of metal sections located on surfaces of the second substrate; and a plurality of stop-bands located on the surfaces of the second substrate and at positions in which a reflected wave produced by an incident wave on the wave-transparent structure is superposed with the incident wave for enhancement. Specifically, the plurality of stop-bands may be disposed on a vertical orthogonal line along which the first wave-absorbing unit 512 and the second wave-absorbing unit 514 are perpendicular to each other, or disposed near the vertical orthogonal line. The plurality of metal sections and the plurality of stop-bands are connected alternately to form an absorption ring, and the metal patch unit is configured to be perpendicular to each of an absorption ring of the first wave-absorbing unit and an absorption ring of the second wave-absorbing unit. Specifically, an alternation manner is a metal section—a stop-band—a metal section—a stop-band.

According to this embodiment of the disclosure, the wave-transparent structure has a high wave transmittance in an L band, and the wave-absorbing structure has a high absorption rate in a Ku band. Therefore, the integrated wave-absorbing and wave-transparent apparatus including the cascaded wave-transparent structure and wave-absorbing structure can implement high wave transmission in the L band and high absorption in the Ku band, to effectively improve an operating environment of a radio device.

The following describes in detail the wave-absorbing structure with reference to FIG. 1, FIG. 3, and FIG. 5.

Referring to FIG. 5, the wave-absorbing structure 510 is disposed on the wave-transparent structure 508 and includes the first wave-absorbing unit 512 and the second wave-absorbing unit 514 that are perpendicular to each other, where the first wave-absorbing unit 512 and the second wave-absorbing unit 514 are a same wave-absorbing unit 300. The wave-absorbing unit 300 includes: a second substrate 302; a plurality of metal sections located on surfaces of the second substrate 302; and a plurality of stop-bands located on the surfaces of the second substrate 302 and at positions in which a reflected wave produced by an incident wave on the wave-transparent structure 508 is superposed with the incident wave for enhancement. Specifically, the plurality of stop-bands may be disposed on a vertical orthogonal line along which the first wave-absorbing unit 512 and the second wave-absorbing unit 514 are perpendicular to each other, or disposed near the vertical orthogonal line. The plurality of metal sections and the plurality of stop-bands are connected alternately (for example, a metal section—a stop-band—a metal section—a stop-band) to form an absorption ring 304 as a ring loop of the wave-absorbing unit 300, and the metal patch unit is configured to be perpendicular to each of an absorption ring of the first wave-absorbing unit and an absorption ring of the second wave-absorbing unit. In an embodiment, referring to FIG. 1, and FIG. 3, the plurality of stop-bands include a first stop-band R1 and a second stop-band R2 that are the same; and the plurality of metal sections include a first metal section 116 and a second metal section 118, where the first metal section 116, the second metal section 118, the first stop-band R1, and the second stop-band R2 are connected to form an absorption ring 100, the first stop-band R1 is located between a first end of the first metal section 116 and a first end of the second metal section 118 (located on a same side as the first end of the first metal section), and the second stop-band R2 is located between a second end of the first metal section 116 and a second end of the second metal section 118 (located on a same side as the second end of the first metal section). The first metal section 116 and the second metal section 118 each include a semicircular ring and parallel metal sections that extend from two ends of the semicircular ring. The first metal section 116 and the second metal section 118 together form a shape of a runway on sports ground, that is, ends that are of two parallel lines and that are on a same side each is connected to a semicircle. In the embodiment shown in FIG. 1, the first metal section 116 includes a semicircular ring 102 and parallel metal sections 106 and 110 that extend from two ends of the semicircular ring, and the second metal section 118 includes a semicircular ring 104 and parallel metal sections 108 and 112 that extend from two ends of the semicircular ring. In another embodiment, the absorption ring may be further a polygonal ring such as a square ring, a rectangular ring, or a hexagonal ring, and correspondingly, includes more metal sections and stop-bands, for example, includes four metal sections and stop-bands, or six metal sections and stop-bands. The stop-band includes a resistor, where the resistor is used to absorb electromagnetic waves that are subject to constructive interference and that are produced by superposing reflected waves and incident waves. In this embodiment, referring to FIG. 1, resistors are disposed at symmetric positions in the absorption ring, for example, on parallel opposite sides of a polygon, so that compared with asymmetric resistors, reflected waves and incident waves are superposed at the symmetric resistors to produce stronger electromagnetic waves. The absorption ring converts energy of absorbed electromagnetic waves into internal energy of the resistors. In an optional embodiment, the stop-band may further include an inductor and a capacitor.

The following describes in detail the wave-transparent structure with reference to FIG. 2, FIG. 4, and FIG. 5. The wave-transparent structure 508 includes a first substrate and a metal patch unit located on opposite surfaces of the first substrate. The metal patch unit includes a metal solid patch or a metal ring patch. A length of a center line of the metal ring patch is an integer multiple of a wavelength corresponding to a resonance frequency of the metal patch unit. Specifically, referring to FIG. 2, the metal ring patch 200 further includes an inner ring 204 and an outer ring 202 that are concentric; the inner ring 204 is located on a first surface of the first substrate; and the outer ring 202 is located on a second surface of the first substrate, where the first surface is opposite to the second surface, and the length of the center line of the metal ring patch 200 is an average value of a length of the inner ring 204 and a length of the outer ring 202. Referring to FIG. 5, the wave-transparent structure 508 further includes: a first dielectric layer 504, located on the first surface of the first substrate 502 and covering the inner ring 204; and a second dielectric layer 506, located on the second surface of the first substrate 502 and covering the outer ring 202. In this embodiment, the inner ring 204 and the outer ring 202 each is a square ring, a rectangular ring, a circular ring, a hexagonal ring, another polygonal ring, or the like. In this embodiment, the inner ring 204 and the outer ring 202 are configured to be concentric, so that interference from electromagnetic waves can be reduced. In another embodiment, the hexagonal ring can further implement more even distribution of electromagnetic waves.

In a specific example of the disclosure, the wave-transparent structure needs to have a high wave transmittance in an L band and have a high cut-off feature in a Ku band. Therefore, a frequency selection surface (FSS) may be used for implementation. However, it is difficult for a single metal patch or metal ring structure to implement cut-off in such a wide frequency band as the entire Ku band. Therefore, multi-layer band-stop microstructures at different resonance frequencies may be superposed for implementation. In addition, a length of a center line of a simple metal ring patch unit, that is, an average value of lengths of an inner ring and an outer ring of the unit, and a wavelength corresponding to a resonance frequency of the unit are in an integer multiple relationship, and a wavelength corresponding to order-1 resonance of the unit may be made to approach the length of the center line, to well control the resonance frequency. Therefore, in the technical solutions in the disclosure, the metal ring patch unit is used to implement the wave-transparent structure.

In a specific example of the wave-absorbing structure, the wave-absorbing structure needs to have a high wave transmittance at a low frequency and have a high absorption feature in a Ku band. In the technical solutions in the disclosure, a used wave absorption manner is: reflecting electromagnetic waves at a frequency at which absorption is required, and absorbing the electromagnetic waves at a position in which incident waves and reflected waves are superposed. In addition, a three-dimensional wave-absorbing structure is further used. Resistors are designed at positions that correspond to the two stop-bands of the wave-absorbing structure and in which an electric field is enhanced through superposition of incident waves and reflected waves. Metal semicircular rings and metal structure extensions are used to connect the two resistors in an incident direction to form a loop, so as to convert energy into internal energy of the resistors and achieve an objective of absorption. This can meet a wave absorption requirement of the entire Ku band.

The following gives description by using an example. As shown in FIG. 1 to FIG. 4, an inner diameter Φ1 of the metal semicircular ring is 2 mm to 4 mm, for example, Φ1=2.6 mm; and a width D1 of the metal ring is 0.1 mm to 1 mm, for example, D1=0.6 mm. A distance L1 between two metal semicircular rings on a same plane is 1 mm to 4 mm, for example, L1=2 mm. An opening extension L2 of the metal ring is 0.1 mm to 1.5 mm, for example, L2=0.9 mm. A resistance R1 is 50Ω to 1000Ω, for example, R1=500Ω. A resistance R2 is 50Ω to 1000Ω, for example, R2=150Ω. A side length L3 of a small metal square ring (namely, the inner ring) is 3 mm to 5 mm, for example, L3=4.1 mm. A side length L4 of a large metal square ring (namely, the outer ring) is 5 mm to 8 mm, for example, L4=5.66 mm. A width D2 of the metal ring is 0.1 mm to 1 mm, for example, D2=0.2 mm. A thickness of the metal part is 20 μm, and metal such as copper, silver, and gold may be used. In an absorption part, a length L5 of a dielectric backplane is 8 mm to 10 mm, for example, L5=8 mm; a width D3 is 3 mm to 8 mm, for example, D3=4 mm; and a thickness H1 is 0.5 mm to 2 mm, for example, H1=0.8 mm. In a reflection part, a thickness H2 of a high-dielectric skin material on each side of a laminated structure is 0.2 mm to 1 mm, for example, H2=0.5 mm; and a thickness H3 of a low-dielectric sandwich material is 1 mm to 8 mm, for example, H3=6 mm. In a transmission part, the two metal square rings are separately disposed at positions P1 and P2. A dielectric constant ε used for both the skin of the wave-transparent structure and the substrate of the wave-absorbing structure is 3.1, and a loss tangent is 0.6%. A composite structure is shown in FIG. 5. Simulation results are shown in FIG. 6 to FIG. 11. Average values of the simulation results (for example, at 0°, 10°, 20°, 30°, 40°, 50°, and 60°) are counted, as shown in Table 1. It can be learned from the simulation results that an objective of a high wave transmittance in the L band and a high absorption rate in the Ku band has been achieved.

TABLE 1

| | TE wave transmittance (L) | TM wave transmittance (L) | TE absorption (Ku) | TM absorption (Ku) |
|---|---|---|---|---|
| 0° | 0.8930 | 0.8936 | 0.9263 | 0.9265 |
| 10° | 0.8915 | 0.8969 | 0.9236 | 0.9252 |
| 20° | 0.8844 | 0.9041 | 0.9186 | 0.9256 |
| 30° | 0.8728 | 0.9161 | 0.9095 | 0.9278 |
| 40° | 0.8514 | 0.9322 | 0.8913 | 0.9132 |
| 50° | 0.8134 | 0.9510 | 0.8533 | 0.8682 |
| 60° | 0.7394 | 0.9673 | 0.7689 | 0.7738 |

Figure 6:
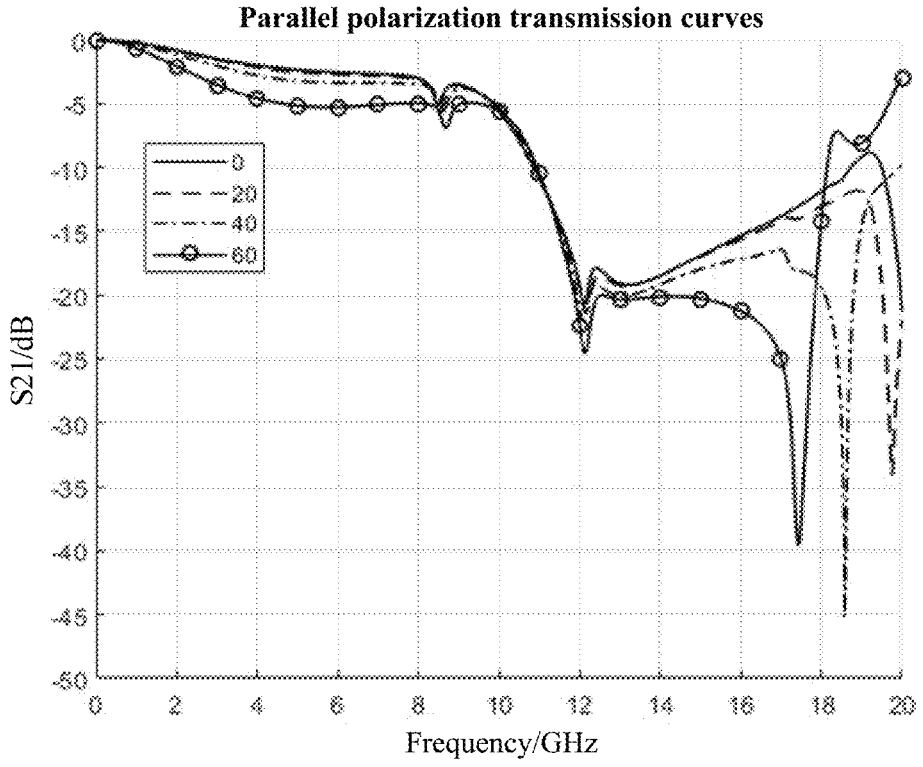
FIG. 6 is a diagram of parallel polarization transmission curves of an integrated wave-absorbing and wave-transparent apparatus according to an embodiment of the disclosure.
Figure 11:
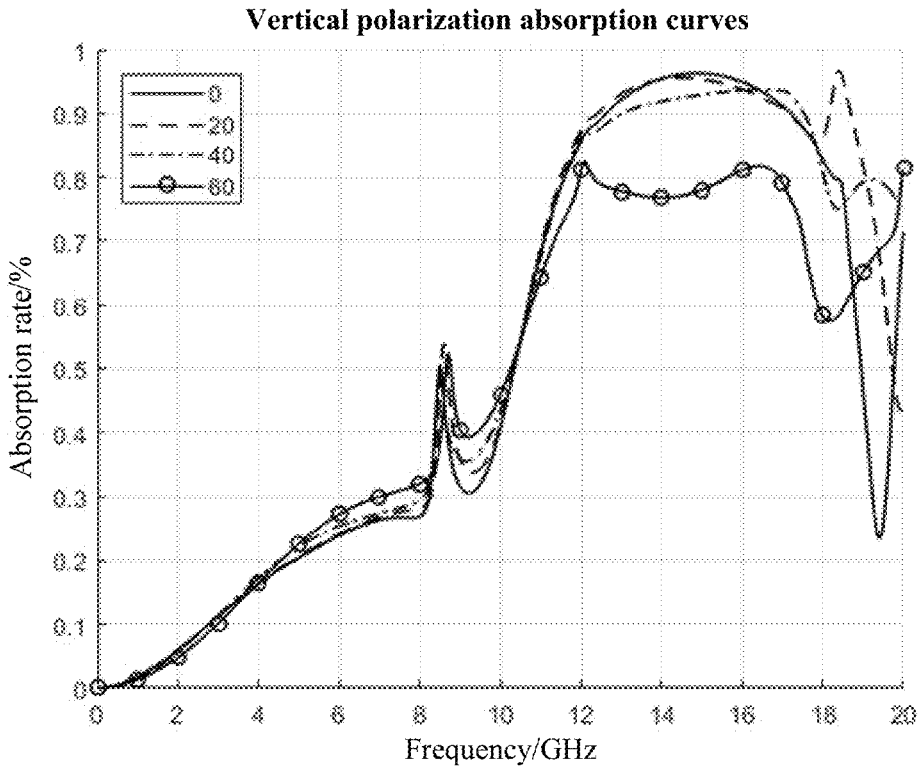
FIG. 11 is a diagram of vertical polarization absorption curves of an integrated wave-absorbing and wave-transparent apparatus according to an embodiment of the disclosure.

For clarity, FIG. 6 and FIG. 11 show parallel polarization transmission curves, parallel polarization reflection curves, parallel polarization absorption curves, vertical polarization transmission curves, vertical polarization reflection curves, and vertical polarization absorption curves respectively. In the accompanying drawings, S21 indicates a transmittance, where in the S21, "1" indicates an incident port, and "2" indicates an emergent port; and S11 indicates a reflectivity, where "1" in the S11 indicates an incident port.

Figure 7:
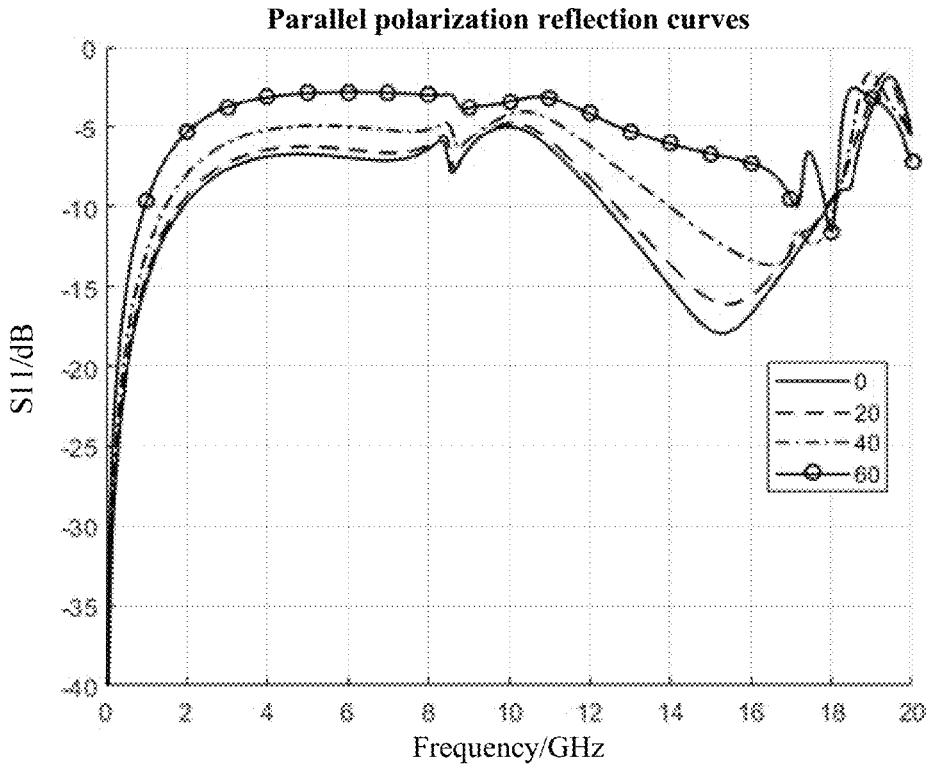
FIG. 7 is a diagram of parallel polarization reflection curves of an integrated wave-absorbing and wave-transparent apparatus according to an embodiment of the disclosure.
Figure 8:
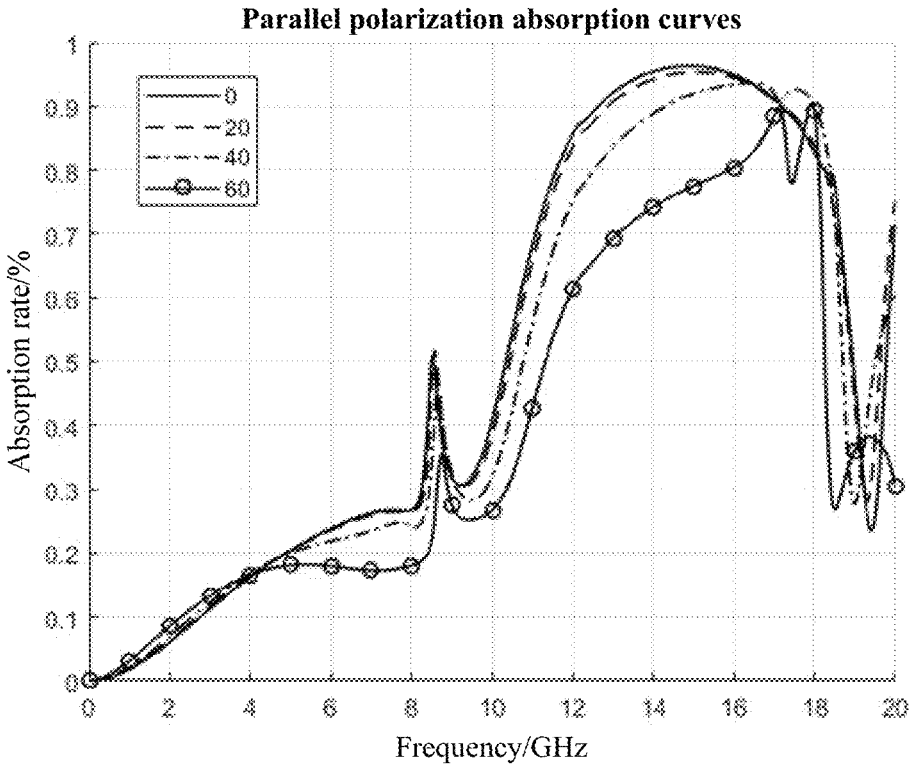
FIG. 8 is a diagram of parallel polarization absorption curves of an integrated wave-absorbing and wave-transparent apparatus according to an embodiment of the disclosure.
Figure 9:
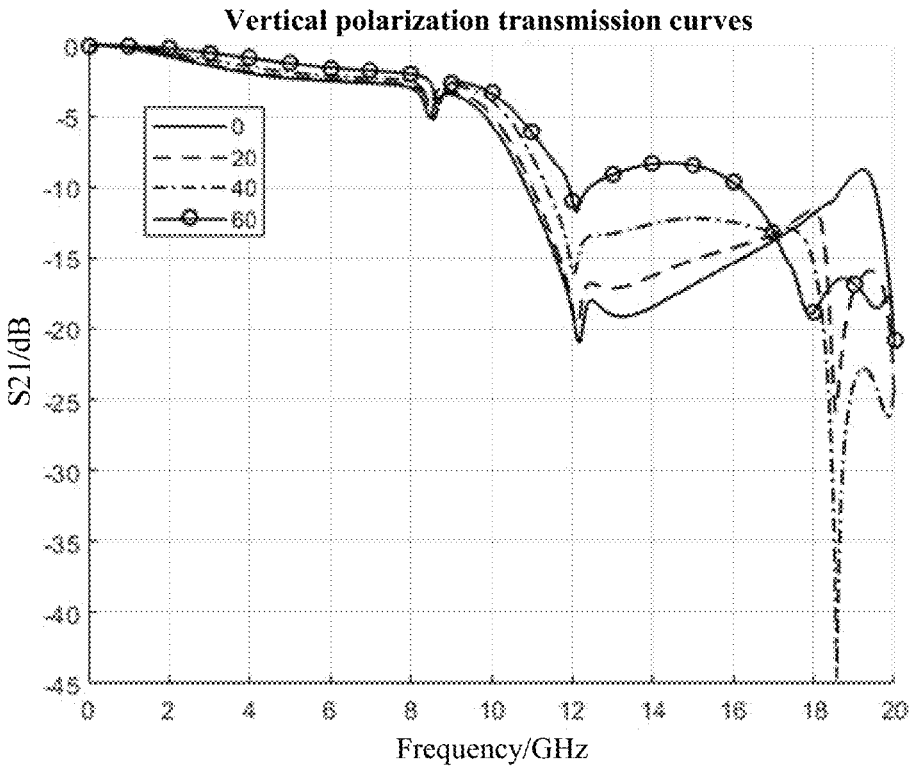
FIG. 9 is a diagram of vertical polarization transmission curves of an integrated wave-absorbing and wave-transparent apparatus according to an embodiment of the disclosure.
Figure 10:
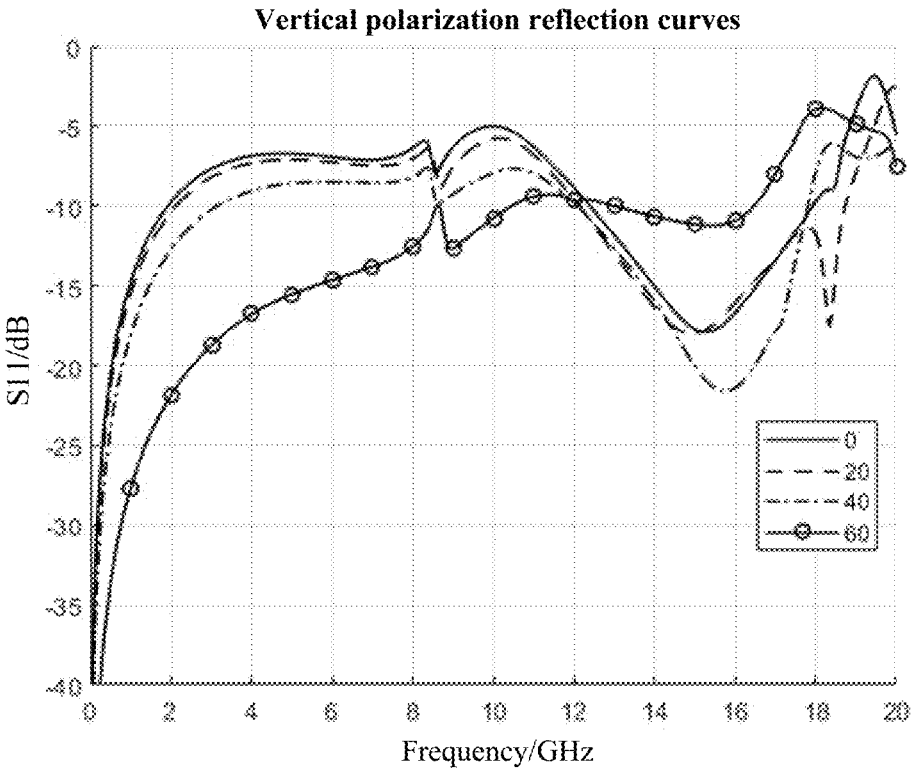
FIG. 10 is a diagram of vertical polarization reflection curves of an integrated wave-absorbing and wave-transparent apparatus according to an embodiment of the disclosure.

It can be learned from FIG. 6 and FIG. 9 that the integrated wave-absorbing and wave-transparent apparatus has a high transmittance in the L band (1-2 GHz) and has a high cut-off feature in the Ku band (12.75-18.1 GHz), for example, has an obvious local lowest point at 12.2 GHz. In FIG. 8 and FIG. 11, the integrated wave-absorbing and wave-transparent apparatus has a very low absorption rate in the L band and has a high absorption rate in the Ku band. In FIG. 7 and FIG. 10, the wave reflectivity has no significant change.

The disclosure may be used as a protection cover of a device such as a communications antenna or a radar, and can ensure absorption in a wide frequency band and a wide angular domain while ensuring normal operating of an antenna, thereby ensuring a good operating environment for the antenna.

According to an embodiment of the disclosure, a radome is further provided. The radome includes the foregoing integrated wave-absorbing and wave-transparent apparatus. The integrated wave-absorbing and wave-transparent apparatus includes: a wave-transparent structure, including a first substrate and a metal patch unit located on opposite surfaces of the substrate; and a wave-absorbing structure, located above the wave-transparent structure and including a first wave-absorbing unit and a second wave-absorbing unit that are perpendicular to each other, where the first wave-absorbing unit and the second wave-absorbing unit each includes: a second substrate; a plurality of metal sections located on surfaces of the second substrate; and a plurality of stop-bands located on the surfaces of the second substrate and at positions in which a reflected wave produced by an incident wave on the wave-transparent structure is superposed with the incident wave for enhancement, where the plurality of metal sections and the plurality of stop-bands are connected alternately to form an absorption ring, and the metal patch unit is configured to be perpendicular to each of an absorption ring of the first wave-absorbing unit and an absorption ring of the second wave-absorbing unit.

In the disclosure, a three-dimensional metamaterial and a simple two-dimensional frequency selection surface are cascaded, and a structure is simple. The integrated wave-absorbing and wave-transparent apparatus according to the embodiments of the disclosure can achieve a high wave transmittance in an L band and a high absorption rate in a Ku band within a wide angular-domain range. The integrated wave-absorbing and wave-transparent apparatus may be used as a protection cover of a device such as a communications antenna or a radar, and can ensure absorption in a wide frequency band and a wide angular domain while ensuring normal operating of an antenna, thereby ensuring a good operating environment for the antenna.

Finally, it should be noted that the foregoing embodiments are merely intended for describing the technical solutions of the disclosure, but not for limiting the disclosure. Although the disclosure is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of the disclosure.

What is claimed is:

1. An integrated wave-absorbing and wave-transparent apparatus, comprising:

a wave-transparent structure, comprising a first substrate and a metal patch unit located on opposite surfaces of the first substrate; and a wave-absorbing structure, disposed on the wave-transparent structure and comprising a first wave-absorbing unit and a second wave-absorbing unit that are perpendicular to each other, wherein the first wave-absorbing unit and the second wave-absorbing unit each comprises:

a second substrate; and a plurality of metal sections and a plurality of stop-bands that are located on surfaces of the second substrate, wherein the plurality of metal sections and the plurality of stop-bands are connected alternately to form an absorption ring, and the metal patch unit is configured to be perpendicular to each of an absorption ring of the first wave-absorbing unit and an absorption ring of the second wave-absorbing unit.

2. The integrated wave-absorbing and wave-transparent apparatus as claimed in claim 1, wherein the plurality of stop-bands comprise a first stop-band and a second stop-band that are the same; and the plurality of metal sections comprise a first metal section and a second metal section, wherein the first metal section, the second metal section, the first stop-band, and the second stop-band are connected to jointly form an absorption ring, the first stop-band is located between a first end of the first metal section and a first end of the second metal section, and the second stop-band is located between a second end of the first metal section and a second end of the second metal section.

3. The integrated wave-absorbing and wave-transparent apparatus as claimed in claim 2, wherein the first metal section and the second metal section each comprise a semicircular ring and parallel metal sections that extend from two ends of the semicircular ring.

4. The integrated wave-absorbing and wave-transparent apparatus as claimed in claim 1, wherein the metal patch unit comprises a metal solid patch or a metal ring patch.

5. The integrated wave-absorbing and wave-transparent apparatus as claimed in claim 4, wherein a length of a center line of the metal ring patch is an integer multiple of a wavelength corresponding to a resonance frequency of the metal patch unit.

6. The integrated wave-absorbing and wave-transparent apparatus as claimed in claim 5, wherein the metal ring patch further comprises an inner ring and an outer ring that are concentric;

the inner ring is located on a first surface of the first substrate; and the outer ring is located on a second surface of the first substrate, wherein the first surface is opposite to the second surface, and the length of the center line of the metal ring patch is an average value of a length of the inner ring and a length of the outer ring.

7. The integrated wave-absorbing and wave-transparent apparatus as claimed in claim 6, wherein the wave-transparent structure further comprises:

a first dielectric layer, located on the first surface of the first substrate and covering the inner ring; and a second dielectric layer, located on the second surface of the first substrate and covering the outer ring.

8. The integrated wave-absorbing and wave-transparent apparatus as claimed in claim 6, wherein the inner ring and the outer ring each is a square ring, a rectangular ring, a circular ring, or a hexagonal ring.

9. The integrated wave-absorbing and wave-transparent apparatus as claimed in claim 1, wherein the stop-band comprises an inductor and/or a capacitor.

10. A radome, wherein the radome comprises the integrated wave-absorbing and wave-transparent apparatus as claimed in claim 1.

11. The radome as claimed in claim 10, wherein the plurality of stop-bands comprise a first stop-band and a second stop-band that are the same; and the plurality of metal sections comprise a first metal section and a second metal section, wherein the first metal section, the second metal section, the first stop-band, and the second stop-band are connected to jointly form an absorption ring, the first stop-band is located between a first end of the first metal section and a first end of the second metal section, and the second stop-band is located between a second end of the first metal section and a second end of the second metal section.

12. The radome as claimed in claim 11, wherein the first metal section and the second metal section each comprise a semicircular ring and parallel metal sections that extend from two ends of the semicircular ring.

13. The radome as claimed in claim 10, wherein the metal patch unit comprises a metal solid patch or a metal ring patch.

14. The radome as claimed in claim 13, wherein a length of a center line of the metal ring patch is an integer multiple of a wavelength corresponding to a resonance frequency of the metal patch unit.

15. The radome as claimed in claim 14, wherein the metal ring patch further comprises an inner ring and an outer ring that are concentric;

the inner ring is located on a first surface of the first substrate; and the outer ring is located on a second surface of the first substrate, wherein the first surface is opposite to the second surface, and the length of the center line of the metal ring patch is an average value of a length of the inner ring and a length of the outer ring.

16. The radome as claimed in claim 15, wherein the wave-transparent structure further comprises:

a first dielectric layer, located on the first surface of the first substrate and covering the inner ring; and a second dielectric layer, located on the second surface of the first substrate and covering the outer ring.

17. The radome as claimed in claim 15, wherein the inner ring and the outer ring each is a square ring, a rectangular ring, a circular ring, or a hexagonal ring.

18. The radome as claimed in claim 10, wherein the stop-band comprises an inductor and/or a capacitor.

* * * * *